United States Patent [19]

Smith et al.

[11] Patent Number: 4,753,291

[45] Date of Patent: Jun. 28, 1988

[54] MODULAR WIRELINE TOOL CONNECTOR WITH SWIVEL COUPLING

[75] Inventors: Lonnie J. Smith, Allen; Dennis R. Wood, Plano, both of Tex.

[73] Assignee: Atlantic Richfield Company, Los Angeles, Calif.

[21] Appl. No.: 5,046

[22] Filed: Jan. 20, 1987

[51] Int. Cl.[4] ..... E21B 47/00; F16L 27/04

[52] U.S. Cl. ..... 166/65.1; 285/3

[58] Field of Search ..... 166/54.5, 65.1, 66, 166/384, 250, 385; 339/7, 15, 45 R, 16, 45 M, 104; 285/3, 4, 119; 174/99 E

[56] References Cited

U.S. PATENT DOCUMENTS

| | | | |
|---|---|---|---|
| 4,275,786 | 6/1981 | Lee | 166/66 |
| 4,624,308 | 11/1986 | White | 166/65.1 |
| 4,648,444 | 3/1987 | Busch | 166/65.1 |

*Primary Examiner*—George A. Suchfield
*Assistant Examiner*—Bruce M. Kisliuk
*Attorney, Agent, or Firm*—Michael E. Martin

[57] ABSTRACT

A modular connector for interconnecting a coilable tubing string with a downhole electrical tool and wherein an electric signal conducting cable extends through the tubing string and through the connector. The connector includes a swivel coupling having a coupling body with a spherical socket for receiving a spherical coupling member which is connectable to the downhole tool through a cable connector body secured to the spherical coupling member. A pin disposed in the coupling body projects into a slot in the spherical coupling member to prevent rotation of the tool with respect to the longitudinal central axes of the connector and the tool. The connector includes a frangible coupling for retrieving the tubing string if the downhole tool becomes stuck. Separation of the frangible coupling exposes a fishing head for retrieving the tool. A one-way check valve in the connector body permits injection of fluid into the wellbore through the tubing string while precluding wellbore fluids from flowing in the opposite direction up through the tubing string. The connector body is adapted to be connected directly to the downhole tool if the swivel coupling is not required.

8 Claims, 3 Drawing Sheets

MODULAR WIRELINE TOOL CONNECTOR WITH SWIVEL COUPLING

BACKGROUND OF THE INVENTION

1. Field of the Invention

The present invention pertains to an improved modular wireline tool connector for interconnecting a downhole tool with a tubing string having an electrical conductor or wireline cable extending therethrough.

2. Background

In operations in wellbores for producing hydrocarbon fluids and other values, difficulties arise in positioning and operating certain types of downhole tools. Various types of electrically operated downhole tools such as logging sondes and perforating tools are sometimes preferably positioned in the wellbore utilizing elongated bendable metal tubing, referred to in the art as coiled or coilable tubing, having an electrical cable or wireline extending therethrough.

However, certain problems arise with respect to extending the electrical cable within the bendable tubing to a connection point with the tool while also providing a suitable connector between the tool and the tubing string. In this regard, certain improvements have been made in apparatus and methods for operating wireline tools in wellbores such as disclosed in U.S. Pat. No. 4,685,516 to L. J. Smith et al and application Ser. No. 899,443, filed Aug. 22, 1986, now U.S. Pat. No. 4,706,744, both assigned to the assignee of the present invention.

The present invention provides further improvements in connector devices of the general type discussed herein and disclosed and claimed in the above referenced patent application which overcome certain problems in providing a modular connector system having a separable or frangible coupling portion and a swivel coupling assembly.

SUMMARY OF THE INVENTION

The present invention provides a modular connector apparatus for interconnecting a subsurface or so called downhole well tool with an elongated tubing string and wherein electrical conductors extend through the tubing string and the connector to the tool itself.

In accordance with one important aspect of the present invention, there is provided a wireline connector for interconnecting a wireline or similar electrical tool with a tubing string wherein a swivel coupling is provided which permits lateral displacement of the tool with respect to the tubing string in the borehole while precluding substantial rotation of the tool relative to the tubing string.

In accordance with another important aspect of the invention, a unique swivel coupling is provided which includes a generally spherical or ball type coupling member which is generally omnidirectionally movable in a socket formed in a coupling body member without permitting rotation of a tool connected to the coupling relative to the remainder of the connector or the tubing string.

In accordance with yet another aspect of the present invention, a modular connector assembly is provided which permits connection of a subsurface wireline tool or the like directly to a part of the connector, including a frangible coupling, without the swivel coupling portion, or the swivel coupling may be interposed between the connector having the frangible coupling and the subsurface tool.

The removable swivel coupling member is also adapted to provide electrical connections between a subsurface electrical tool and electrical conductors disposed in the connector apparatus.

The abovementioned features and advantages of the present invention, together with other superior aspects thereof, are described in further detail herein. These features and advantages will be further appreciated by those skilled in the art upon reading the detailed description which follows in conjunction with the drawing.

BRIEF DESCRIPTION OF THE DRAWING

FIG. 1 is a view illustrating the use of the connector of the present invention for supporting a downhole well tool at the end of a tubing string or the like.

DESCRIPTION OF A PREFERRED EMBODIMENT

Figure 1:
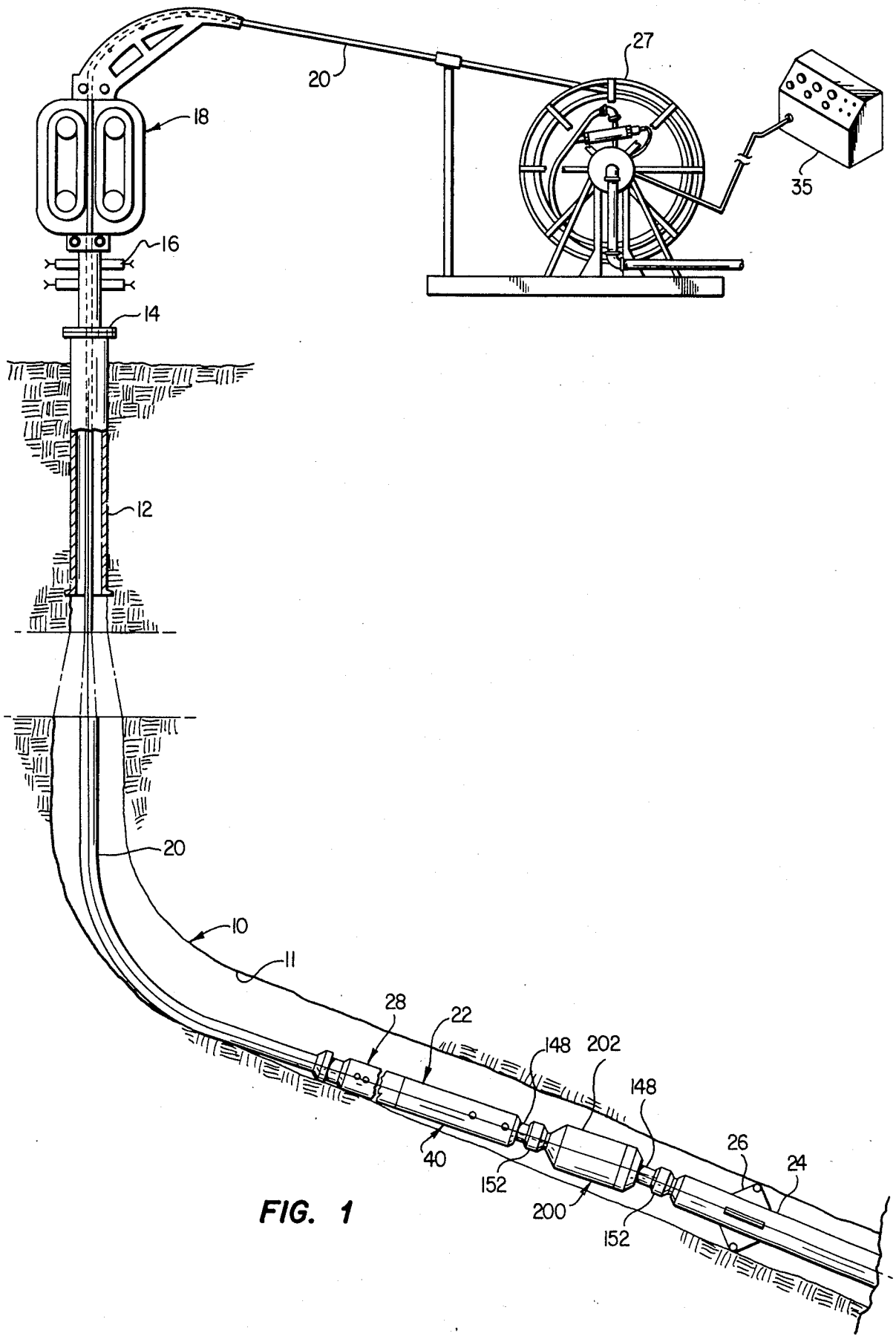

In the description which follows, like parts are marked throughout the specification and drawing with the same reference numerals, respectively. The drawing figures are not necessarily to scale and certain features of the invention may be shown exaggerated in scale in the interest of clarity and conciseness.

Referring to FIG. 1, there is illustrated a typical deviated wellbore, generally designated by the numeral 10. The wellbore 10 may include an open or uncased lower portion 11. A casing 12 extends to a wellhead 14 which may be provide with a conventional blowout preventer assembly 16 and a wellhead mounted coiled tubing injector 18. An elongated coilable metal tubing string 20 extends through the injector 18 and into the wellbore and terminates at its lower end in a modular connector in accordance with the present invention and generally designated by the numeral 22.

The connector 22 is adapted to interconnect the tubing string 20 with a tool 24 which may be a conventional casing perforating gun, a logging sonde, or other type of subsurface or downhole tool. The tool 24 may include centering means 26 of conventional construction for centering the tool in the wellbore. The connector 22 includes an upper body member 28 which is coupled directly to the tubing string 20 and may be journaled by a centralizer, not shown. The centralizer may be of conventional construction or of the type described in the above referenced, first mentioned copending patent application.

The tubing string 20 may comprise an elongated section of bendable metal tubing which extends from the connector 22 through the injector 18 which is adapted to receive tubing from a storage reel 27. The tubing string 20 may also be made up of end to end coupled tube sections and is not required to be constructed of metal since certain plastic materials or non-metallic composites may also be used as the structural material for the tubing string.

Figure 2A:
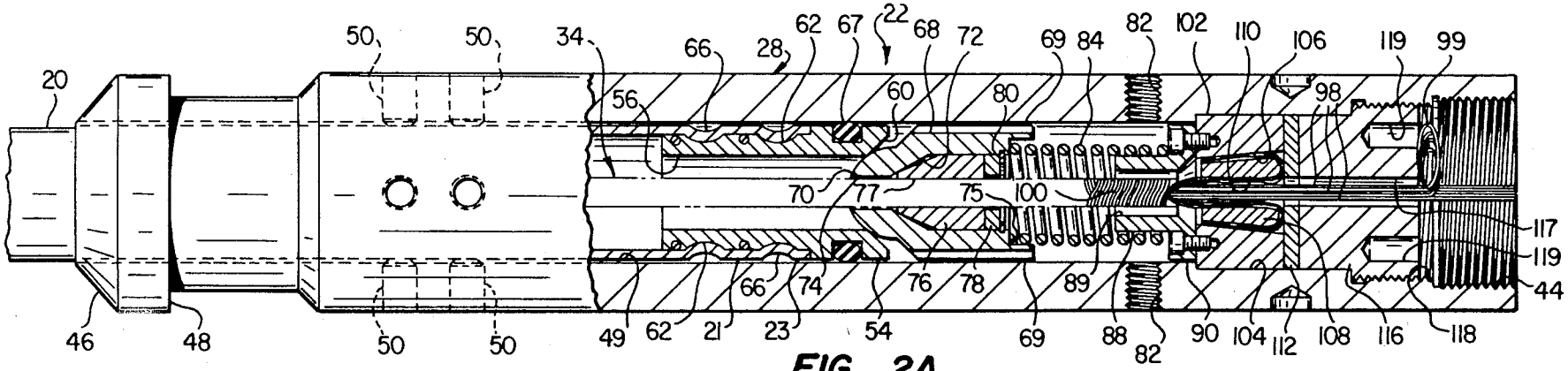
FIGS. 2A, 2B, and 2C comprise a longitudinal central section view of the connector.

Referring now to FIG. 2A, the tubing string 20 includes an elongated electrical cable extending therethrough and generally designated by the numeral 34. The cable 34 is adapted to be electrically connected to a suitable control apparatus 35, FIG. 1, on the surface and to extend through the tubing string 20 and the connector 22 to the tool 24 for transmitting electrical signals between the control apparatus and the tool. The connector 22 includes a lower body member 40, FIG. 2B, which is adapted to be removably connected to the upper body member 28 by a reduced diameter threaded portion 42 which may be threadedly inserted in an internally threaded bore 44 in the body member 28. The terms upper and lower mentioned herein are for convenience only and refer to the relative locations of the respective members so designated when the connector 22 is inserted in a generally vertically extending wellbore. The upper end of the connector body 28 includes a fishing neck comprising a generally conical surface 46 and an annular transverse shoulder 48 whereby, in the unlikely event that the connector 22 is separated from the tubing string 20, a fishing tool may be lowered into the wellbore to engage the body member 28.

The body member 28 is an elongated, generally cylindrical member having a bore 49 extending therethrough and adapted to receive the lower end portion 21 of the tubing string 20. The tubing string 20 is secured to the body member 28 by setscrews 50 which are threadedly engaged with the body member 28 and forcibly engage the tubing end portion 21. The very distal end 23 of the tubing end portion 21 is coupled to a valve seat member 54 having a longitudinal fluid passage or bore 56 formed therein. The seat member 54 includes a valve seat surface 60 of somewhat spherical or frustonconical shape. The seat member 54 has spaced apart annular grooves 62 for receiving inwardly displaced portions 66 of the tubing end 23 whereby the tubing string 20 is secured to the seat member 54. A fluid seal is formed by an o-ring 67 disposed in a groove formed in the seat member 54 and engagable with the wall defining the bore 49.

The connector 22 includes a valve closure member 68 having a generally hemispherical head portion 70 and a partially frustoconical shaped central passage 72. The closure member 68 also includes a longitudinal bore 74 formed in the head 70 and opening into the passage 72. A seal member 76 is disposed in the bore 72 and retained therein by a support ring 78 and a removable retaining ring 80. The seal member 76 may be formed of a suitable resilient material such as molded polyurethane and includes a bore 77 formed therein which is adapted to be aligned with the bore 74 formed in the closure member 68. The closure member 68 includes at least two opposed, radially extending guides 69, for guiding the closure member for axial movement in the bore 49 while permitting the flow of fluids from the bore 56 past the closure member and out of the connector body 28 through threaded passages 82. The closure member 68 is biased into engagement with the valve seat member 54 by a coil spring 84 which has one end disposed in a recess 75 formed in the closure member 68. The other end of spring 84 is guided on a spigot 88 formed on a retainer plate 90, also adapted to be disposed in the bore 49.

The cable 34 may be a conventional multiple conductor cable, also commonly known as a wireline cable having a plurality of insulated electrical conductors 98 disposed in a sheath which may include plural layers of wound or braided steel wire 100 or other suitable elongated filaments. The cable 34 extends through a bore 89 formed in the retainer plate 90 and is anchored in the body member 28 by a generally cylindrical anchor body 102 which is disposed in an enlarged bore portion 104 coaxial with the bore 49. The anchor body 102 includes a central bore 106 which is adapted to receive a frustoconical shaped anchor plug 108. The plug 108 includes a bore 110 formed therein through which the conductors 98 and unwound sheath wires 100 are extended.

The cable sheath wires 100 are bent over and trapped between the anchor plug 108 and the anchor body 102 and retained by a plate 112. The retainer plate 112, the anchor body 102 and the anchor plug 108 are secured in assembly and in the bore 104 by a retaining plug 116 which is threadedly engaged with an internally threaded portion 118 of the connector body 28. The plug 116 may include suitable recesses 119 for receiving the lugs of a suitable spanner wrench, not shown, for securing the plug in the connector body 28, as illustrated. The plug 116 also includes a central bore 117 through which the conductors 98 may extend to the lower connector body 40. The conductors 98 are preferably provided to have a strain relief loop 99 formed therein to facilitate assembly and disassembly of the connector body members 28 and 40.

Figure 2B:
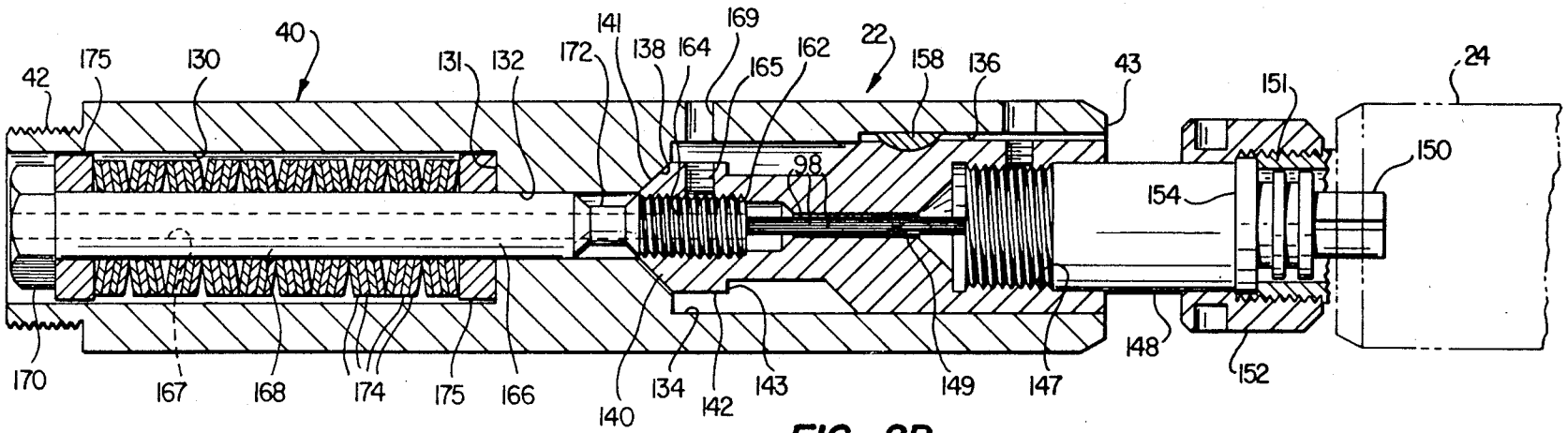

As shown in FIG. 2B, the lower connector body 40 includes a first longitudinal bore 130 extending from the threaded portion 42, a reduced diameter bore 132 and an enlarged bore portion 134 which extends from the bore 132 to the opposite end of the lower connector body. A longitudinal keyway 136 extends partially into the bore 134 from the end 43 of the body 40 opposite the threaded portion 42. A somewhat frustoconical shaped surface 138 is interposed between the bores 132 and 134 for seating a fishing head 140 of a coupling member 142. The head 140 includes a conical surface 141 and a transverse annular shoulder 143 for engagement with a suitable fishing tool, not shown, to retrieve the coupling member 142 and the tool 24 connected thereto. The coupling member 142 includes an internally threaded portion 147 for receiving a cable connector body 148 threadedly engaged therewith.

The cable connector body 148 is of a type commercially available from SIE Wireline Products of Fort Worth, Tex., and includes a suitable multiconductor socket member 150 which is adapted to couple the conductors 98 electrically directly to suitable signal transmitting conductors, not shown, within the tool 24, for example. If a swivel connection between the tubing string 20 and the tool 24 is not required or considered desirable, the tool 24 may be coupled directly to the connector which comprises the body members 28 and 40 and the components therein, as illustrated in FIGS. 2A and 2B. The cable connector body 148 may be threadedly coupled to a boss 151 on the tool 24 by a nut 152 which is retained on the body 148 by an annular shoulder 154. Accordingly, the conductors 98 may extend through a bore 149 in the coupling member 142, into and through the cable connector body 148 and be suitably terminated at the socket member 150. The coupling member 142 includes a keyseat for receiving a key 158 which is disposed in the keyway 136 to prevent rotation of the coupling member 142 relative to the connector body 40. This non-rotation feature may be of importance in rotationally orienting certain downhole tools connected to the tubing string 20. Moreover, unrestrained rotation of the cable connector body 148 relative to the connector 22 could damage the conductors 98.

Referring further to FIG. 2B, the head 140 is provided with an internally threaded passage 162 for receiving a threaded end portion 164 of an elongated coupling pin 166. The threaded portion 164 is locked to the coupling member 142 by a suitable set screw 165 which is accessible through an opening 169. The pin 166 includes a shank portion 168 and a hexagonal cross section head 170. The coupling pin 166 includes a reduced diameter portion 172 interconnecting the threaded end portion 164 with the shank 168 and having a predetermined cross sectional area which will cause the shank 168 to separate from the threaded portion 164 in response to a predetermined tension load being exerted on the connector 22 by the tubing string 20, for example. The pin 166 includes a longitudinal bore 167 extending therethrough for passage of the conductors 98. The pin 166 is slidable in the bore 132 and closely fitted therein and is retained in the body 40 by resilient means comprising a plurality of stacked conical spring washers 174, interposed between the head 170 and a transverse surface 131 delimiting the bore 130. Suitable retaining washers 175 are disposed between the head 170 and the surface 131 and at opposite ends of the stack of spring washers. The spring washers 174 are preloaded to a predetermined degree upon assembly of the pin 166 to the coupling member 142 to minimize unwanted axial excursions of the tool 24 relative to the connector 22.

Figure 2C:
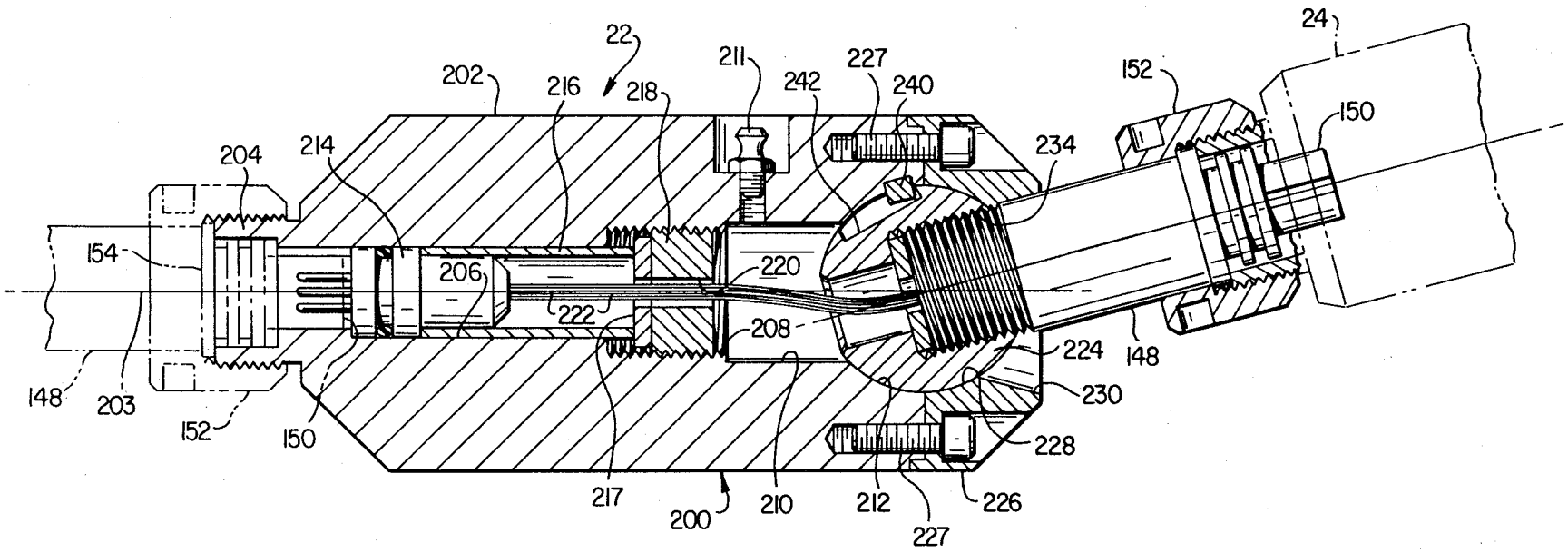

Referring now to FIG. 2C, the connector assembly 22 includes a swivel coupling, generally designated by the numeral 200, having a coupling body 202 characterized by a reduced diameter portion 204 which is externally threaded for connection to the connector body 40 by way of the nut 152 and cable connector body 148. Accordingly, in place of connecting the cable connector body 148 directly to the tool 24, the swivel coupling body 202 may be preferably secured to the connector body 40 as aforementioned.

The coupling body 202 includes a longitudinal bore 206 having a first enlarged portion 208 which is internally threaded and a second enlarged portion 210 which opens into a spherical socket defined by the surface 212. A multipin electrical connector plug 214 is disposed in the bore 206 and retained therein by a sleeve 216, a washer 217 and a retainer plug 218. Passage means 220 are provided in the washer 217 and the plug 218 through which conductor wires 222 extend between the plug 214 and a second connector body 148.

A generally spherical coupling member 224 is secured to the body 202 for lateral swiveling displacement relative thereto by a removable cap 226 forming part of the socket defined also by the surface 212. The cap 226 includes a spherical surface portion 228 and a frustoconical bore 230 intersecting the surface 228 to provide clearance for swiveling movement of the electrical connector body 148 relative to the coupling body 202. The coupling member 224 is provided with an internally threaded bore 234 for receiving an externally threaded portion of the connector body 148. The cap 226 is suitably retained in assembly with the coupling body 202 by removable threaded fasteners 227. A generally cylindrical pin 240 is secured to the coupling body 202 and projects into the socket defined by the surface 212 and also into an elongated slot 242 formed in the coupling member 224. The pin 240 and the slot 242 cooperate to permit substantially free swiveling movement of the coupling member 224 relative to the coupling body 202 while precluding rotation of the coupling member 224 and electrical connector body 148 about their longitudinal axes and relative to the longitudinal central axis 203 of the coupling body 202. As illustrated in FIG. 2C, the connector body 148 is also provided with a nut 152 for securing the connector body to the tool 24 in the same manner as the electrical connector body supported by the connector body 40 is connected to the same tool, if desired. The joint formed between the coupling member 224 and the coupling body 202 may be lubricated with a suitable lubricant injected into the bore 210 by way of a recessed fitting 211. The injection of a suitable thixotropic lubricant into the bore 210 also packs the bore as well as the space within the coupling body 202 occupied by the conductors 222 to prevent the incursion of foreign fluids.

Moreover, in the event that the tool 24 should become stuck in the wellbore, and upon exercise of a sufficient upward pulling force on the tubing string 20, the pin shank 168 will separate from the coupling member 142 and that portion of the connector comprising the body members 28 and 40 will be retrieved from the wellbore leaving the fishing head 140 exposed for engagement with a suitable fishing tool.

Separation of the connector 22 as described above will typically result in parting of the conductors 98 at some point between the anchor body 102 and the connector body 148. This relatively short length of exposed, relatively small diameter and flexible conductors 98 will generally not interfere with maneuvering a fishing tool into engagement with the head 140 so that the coupling member 142 and the tool 24 can be retrieved by conventional fishing techniques.

The operation of the connector is believed to be readily understandable to those skilled in the art from the foregoing description of its structural features. Conventional engineering metals and elastomeric materials may be used in constructing the connector 22.

Although a preferred embodiment of the invention has been described in detail herein, those skilled in the art will recognize that various substitutions and modifications may be made to the specific embodiment disclosed without departing from the scope and spirit of the invention as recited in the appended claims.

What we claim is:

1. A modular connector for interconnecting a downhole tool adapted to be disposed in a wellbore with an elongated tubing string, said tubing string including an elongated signal transmitting cable extending therein for transmitting signals between said tool and the earth's surface, said connector comprising:

an elongated body member connected at one end to said tubing string, said body member including means forming a bore through which said cable extends; and a swivel coupling interconnecting said body member with said tool to permit lateral displacement of said tool relative to said tubing string, said swivel coupling including a generally spherical coupling member secured in a socket in a coupling body, said spherical coupling member and said coupling body including passage means for extending electrical conductors between said connector and said tool through said swivel coupling.

2. The connector of claim 1 wherein:

said swivel coupling includes means substantially precluding rotation of said tool relative to said body member about the longitudinal axis of said body member.

3. The connector of claim 1 including:

means on said connector for anchoring a portion of said cable relative to said body member.

4. The connector of claim 2 wherein:

said means substantially precluding rotation includes a pin secured in one of said spherical coupling member and said coupling body and disposed in a cooperating slot formed in the other of said spherical coupling member and said coupling body.

5. The connector of claim 1 including:

frangible coupling means operably connected to said body member and to said swivel coupling and responsive to an axial pulling force on said tubing string to separate said connector from said tool at a predetermined force exerted on said frangible coupling means, said franglible coupling means including separable members defining passage means for extending signal conductors of said cable through said frangible coupling means to said swivel coupling.

6. The connector of claim 5 wherein:

said frangible coupling means includes an elongated pin having a reduced diameter portion, said pin being supported in said body member, and means interconnecting said pin and said swivel coupling and separable from said pin in response to an axial pulling force on said pin.

7. A connector for interconnecting a downhole tool adapted to be disposed in a wellbore with an elongated tubing string, said tubing string including an elongated signal transmitting cable extending therein for transmitting signals between said tool and he earth's surface, said connector comprising:

an elongated body member connected at one end to said tubing string, said body member including means forming a bore through which said cable extends;

means on said connector for anchoring a portion of said cable relative to said body member;

a swivel coupling interconnecting said body member with said tool to permit lateral displacement of said tool relative to said tubing string, said swivel coupling including a generally spherical coupling member connected to said tool and secured in a socket in a coupling body, said spherical coupling member and said coupling body including passage means for extending electrical conductors between said connector and said tool through said coupling, and means interposed between said spherical coupling member and said coupling body substantially precluding rotation of said tool relative to said body member about the longitudinal axis of said body member.

8. A modular connector for interconnecting a downhole tool adapted to be disposed in a wellbore with an elongated tubing string, said tubing string including an elongated signal transmitting cable extending therein for transmitting signals between said tool and the earth's surface, said connector comprising:

an elongated body member connected at one end to said tubing string, said body member including means forming a bore through which said cable extends;

a swivel coupling for interconnecting said body member with said tool to permit lateral displacement of said tool relative to said tubing string, said swivel coupling including a generally spherical coupling member secured in a socket in a coupling body, said spherical coupling member and said coupling body including passage means for extending electrical conductors between said connector and said tool through said coupling; and a connector body including means for selectively connecting said elongated body member to one of said tool and said swivel coupling, said connector body including electrical conductor means extending therein for making electrical connections between one of said tool and said swivel coupling, respectively.

* * * * *